US005277629A

United States Patent [19]

Rissik et al.

[11] Patent Number: 5,277,629

[45] Date of Patent: Jan. 11, 1994

[54] BATTERY CLAMP CONNECTORS

[76] Inventors: George V. Rissik, 66 Goethe Road, Lombardy East, Transvaal Province; Wilbraham C. K. Vickers, 21 Lucas Road, Eastleigh, Edenvale, Transvaal Province, both of South Africa

[21] Appl. No.: 5,182

[22] Filed: Jan. 15, 1993

Related U.S. Application Data

[62] Division of Ser. No. 886,110, May 21, 1992, abandoned.

[51] Int. Cl.[5] ..... H01R 4/50

[52] U.S. Cl. ..... 439/770; 439/772

[58] Field of Search ..... 439/372, 760; 765, 770, 772, 774, 784, 796, 797, 807, 863

[56] References Cited

U.S. PATENT DOCUMENTS

| | | | |
|---|---|---|---|
| 1,805,857 | 5/1931 | Trimble et al. | 439/774 |
| 2,737,638 | 3/1956 | Lade | 439/774 |
| 2,818,552 | 12/1957 | Zam | 439/522 |
| 3,867,007 | 2/1975 | Wening | 439/770 |
| 3,990,769 | 11/1976 | Bureau | 439/770 |
| 4,576,430 | 3/1986 | Dufresne | 439/772 |

FOREIGN PATENT DOCUMENTS

| | | | |
|---|---|---|---|
| 2833573 | 2/1979 | Fed. Rep. of Germany | 439/770 |
| 1091782 | 4/1955 | France | 439/770 |

*Primary Examiner*—Paula A. Bradley

*Attorney, Agent, or Firm*—Jacobson, Price, Holman & Stern

[57] ABSTRACT

A battery clamp for connection of electrical cables to a terminal post of an electric storage battery has a body of electrically conductive material an aperture formed therethrough to accommodate the terminal post and includes cam operated locking means for releasably securing the clamp to the post and also means for releasably securing at least one electric cable to the clamp.

Also disclosed is a cam operated electrical cable connector for use with the battery clamp or a suitably adapted cable adaptor.

3 Claims, 2 Drawing Sheets

BATTERY CLAMP CONNECTORS

This is a division of U.S. application Ser. No. 07,886,110, filed May 21, 1992 which was abandoned upon the filing hereof.

FIELD OF THE INVENTION

This invention relates to clamps for electric storage batteries and to cable connectors used in conjunction therewith. An application is described for motor vehicle batteries but the invention is not exclusively confined thereto.

BACKGROUND TO THE INVENTION

Battery clamps for securing electrical leads to the terminal posts of motor vehicle batteries generally have securing means comprising an "U" shaped body having a bolt passing through the legs and secured by a nut on the threaded end of the bolt. This system suffers from the disadvantage of requiring a spanner of the correct size to connect or disconnect the clamp and further, the bolt being of a corrosive material, tends to corrode, resulting in difficulty in removal and possible damage to the clamps or terminal post. Although other types of clamp have been used, e.g. a spring release clamp, these suffer from one or other of these disadvantages, resulting in delays when connecting or disconnecting batteries in service.

OBJECT OF THE INVENTION

It is an object of this invention to provide a clamp which is of simple construction and allows for quick release and securement of battery cables to a battery and also provides quick release cable connectors.

SUMMARY OF THE INVENTION

A battery clamp for connection of electric cables to a terminal post of an electric storage battery comprising an electrically conductive material body having an aperture formed therethrough to accommodate said terminal post and, included within the body, are cam operated locking means whereby the clamp may be releasably secured to the terminal post and means for releasably securing at least one electric cable to the clamp.

Further features, according to the invention, the electrically conductive material body is preferably a casting of elongate configuration Still further features, according to the invention, the cam operated locking means is located in a recess in the body and comprises an offset cam having a follower in the form of a slug adapted to slide in the recess and be locked into electrical contact with the battery terminal post.

Still further, according to the invention, the means for releasably securing an electrical cable to the clamp comprises a socket in the body adapted for the insertion and locking therein of a spigot of an electrical connector to which the cable is secured, the spigot having a cam formation thereon whereby the connector may be locked into electrical contact with the clamp.

Still further, according to the invention, preferably the body includes an insulating cover surround adapted to provide openings therethrough for a terminal post, electrical connections and an adjusting boss of the cam operated locking means.

The invention extends to cam connectors for connecting cables to a battery clamp as hereinbefore described or further, for use in a cable extension adaptor having socket outlets suitably adapted for their insertion and locking therein.

BRIEF DESCRIPTION OF THE DRAWINGS

Three embodiments of the invention are described below by way of example only and with reference to the accompanying drawings in which.

DETAILED DESCRIPTION OF THREE PREFERRED EMBODIMENTS OF THE INVENTION WITH REFERENCE TO THE DRAWINGS

Figure 1A:
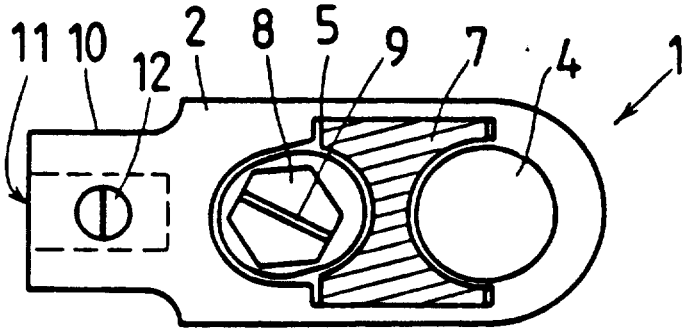
FIG. 1A shows a battery clamp according to the invention in plan.
Figure 1B:
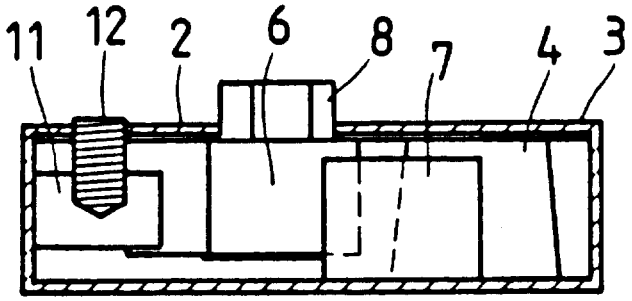
FIG. 1B shows the clamp in cross section.

As illustrated in FIGS. 1A and 1B, there is provided a battery clamp (1) for use in connecting a high tension cable to one of the battery posts of a motor car battery which comprises a cast metal body (2) of oblong shape, enclosed in a plastic cover (3), and having an aperture (4) therethrough shaped to cooperate with the terminal post over which it is located in use.

Formed in the body (2) is a shaped recess (5) in which is located an offset cam (6) adjacent to and spaced from a cam slug (7) which is cast from an electrically conductive material and, more particularly an aluminum alloy, and shaped to be locked by the cam in use against the terminal post and integral with the cam (6) is a boss (8) which projects through the top of the plastic cover (3). In the face of the boss (8) is a slot (9) into which a screw driver may be inserted for adjustment of the cam. In the end (10) of the body remote from the aperture (4) is a short bore (11) for insertion of a high tension cable.

In use the clamp (1), with a cable inserted in the bore (11) and secured to the body (2) by means of a grub screw (12) passing through a tapped bore therein, is placed with aperture (4) located over a terminal post of a battery. The cam (6) is turned by a screwdriver or like instrument inserted in the slot (9) of the boss (8) to force the slug (7) into locking engagement with the terminal post.

Figure 2A:
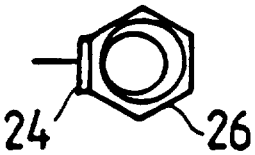
FIG. 2A shows an elevation and FIG. 2B shows a plan of a cam connector according to the invention.
Figure 2B:
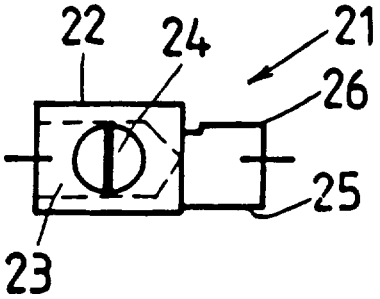

FIGS. 2A and 2B illustrates a cam connector (21) which comprises an aluminum casting part (22) which is of hexagonal shape with a short bore (23) open at one end into which a cable may be inserted and secured in the connector by a grub screw (24) and a spigot end (25) on which is carried an offset cam (26).

Figure 3A:
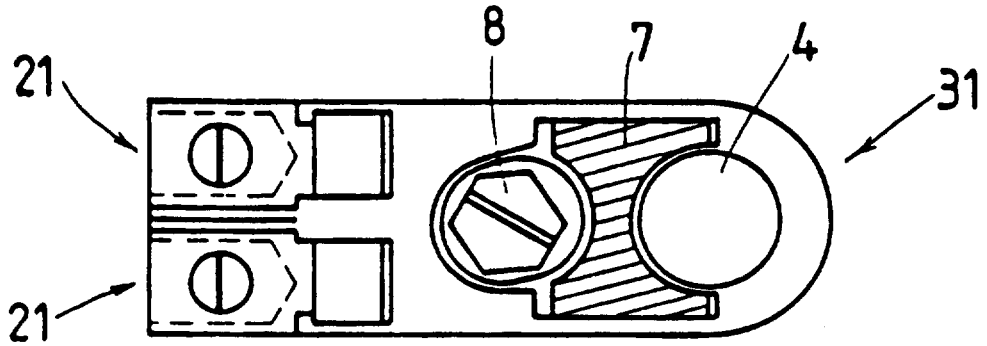
FIGS. 3A and 3B show a battery clamp according to the invention incorporating two removable cam connectors of the type illustrated in FIGS. 2A and 2B.
Figure 3B:
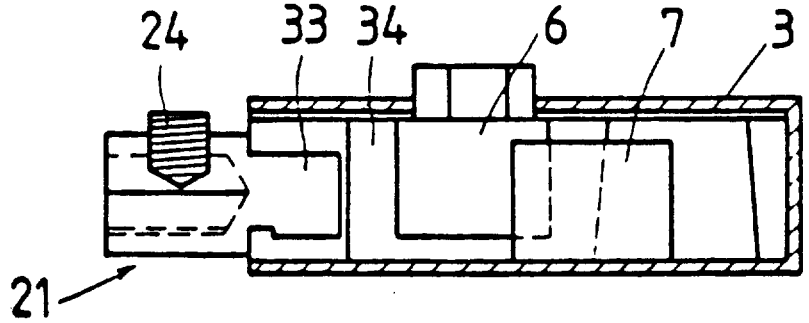

Now referring to FIGS. 3A and 3B, a second embodiment of the invention is illustrated which incorporates cam connectors of the type shown in FIGS. 2A and 2B.

In this embodiment, a battery clamp (31) similar to that of the first embodiment is provided, having two cam connectors (21) secured in locked position within two sockets (33) formed in the body (34) of the clamp, the sockets being formed to cooperate with the cams of the connectors. Like items of clamp (31) with that of the first embodiment are referenced as in FIGS. 1A and 1B.

In this embodiment it will be seen that two cables may be connected to a clamp on one terminal post.

Figure 4:
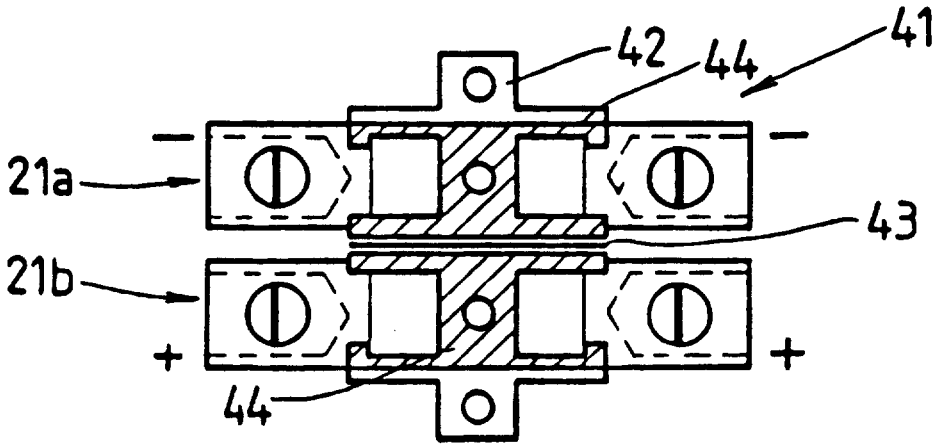
FIG. 4 shows use of removable cam connectors of the type illustrated in FIGS. 2A and 2B in an extension cable adaptor.

Referring to FIG. 4, a third embodiment of the invention illustrates the use of cam connectors in an extension adaptor. In this embodiment an extension adaptor (41) is provided and comprises a plastic open ended box (42) having a partition (43) therein for insulating two aluminum castings (44) held therewithin, each formed having socket outlets on either side of the type to accept cam connectors (21) as hereinbefore described.

In use, the extension adaptor has negative connections (21*a*) on one side and positive connections (21*b*) on the other side. Connections (21*a*) are connected to a clamp on the negative terminal of a battery and connections (21*b*) to a corresponding clamp on the positive terminal of the battery.

It will be seen that the invention provides ease of connection and disconnection for battery clamps when maintenance is carried out and that other embodiments of the invention are envisaged for the connection of cables when, for example, a battery charger is to be used.

What we claim as new and desire to secure by Letters Patent is:

1. A battery clamp for connection of electrical cables to a terminal post of an electric storage battery comprising a body of elongate configuration formed from electrically conductive material, the body including an aperture therethrough to accommodate said terminal post, a recess to accommodate an offset cam and follower arranged to slide in the recess whereby it may be locked into electrical contact with the battery terminal post incorporates at least one electrical connector for releasably securing an electrical cable to the clamp, comprising a spigot for insertion into a socket in the body adapted for its locking therein.

2. A battery clamp as claimed in claim 1 wherein the spigot of the electrical connector includes a cam formation thereon whereby the connector may be locked into electrical contact with the clamp.

3. A battery clamp as claimed in claim 2 having two electrical connectors for releasably securing two electrical cables to the clamp.

* * * * *